US006382784B2

(12) United States Patent
Pawlowski, Jr. et al.

(10) Patent No.: US 6,382,784 B2
(45) Date of Patent: May 7, 2002

(54) PRINTING SYSTEM WITH AIR ACCUMULATION CONTROL MEANS ENABLING A SEMIPERMANENT PRINTHEAD WITHOUT AIR PURGE

(76) Inventors: Norman E Pawlowski, Jr., 1455 NW. 13th; Mark Hauck, 202 NW. 32nd St., both of Corvallis, OR (US) 97330; John Barinaga, 2041 NW. 29th Ave. #7, Portland, OR (US) 97210; Donald E Wenzel, 2820 NW. 12th Ave., Albany, OR (US) 97321

( * ) Notice: Subject to any disclaimer, the term of this patent is extended or adjusted under 35 U.S.C. 154(b) by 0 days.

(21) Appl. No.: 09/789,047

(22) Filed: Feb. 20, 2001

Related U.S. Application Data

(63) Continuation of application No. 09/037,550, filed on Mar. 9, 1998, now Pat. No. 6,203,146.

(51) Int. Cl.[7] ..... B41J 2/175
(52) U.S. Cl. ..... 347/85
(58) Field of Search ..... 347/85, 86, 87, 347/92

(56) References Cited

U.S. PATENT DOCUMENTS 5,971,529 A * 10/1999 Pawlowski et al. ..... 347/86
6,203,146 B1 * 3/2001 Pawlowski et al. ..... 347/85

* cited by examiner

*Primary Examiner*—N. Le
*Assistant Examiner*—Michael Nghiem

(57) ABSTRACT

An inkjet printing system includes a semipermanent printhead having a fluid input for receiving ink and an ejection portion for depositing ink in response to control signals. The printing system also includes a replaceable ink supply configured for providing ink to the printhead that stores an ink volume. The printhead is capable of lasting throughout the life of a plurality of the ink volumes. The printing system includes a fluid accumulator portion in fluid communication with the printhead and the replaceable ink supply. The fluid accumulator is adapted to accommodate the air introduced into the printhead during the usage of the ink supplies without purging air from the printhead. An ink delivery apparatus is described that fluidically couples to the fluid input and provides ink to the printhead. This ink delivery apparatus is adapted to control air introduction to the printhead such that the accumulator portion can accommodate all air introduced during the life the printhead.

17 Claims, 10 Drawing Sheets

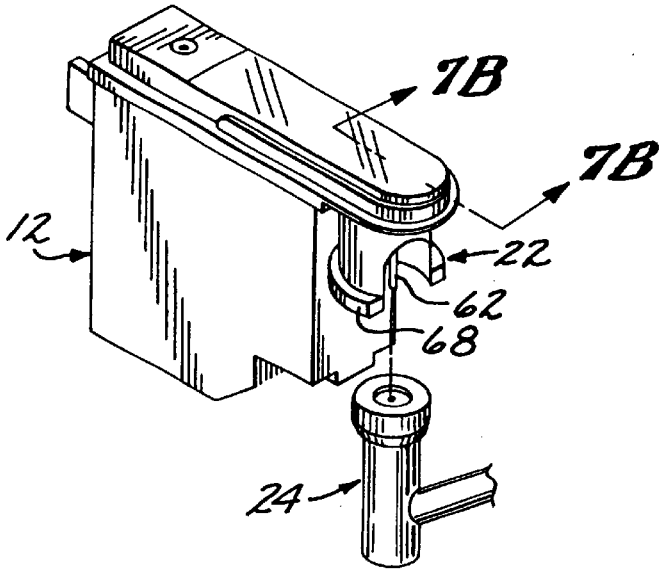
FIG. 7A
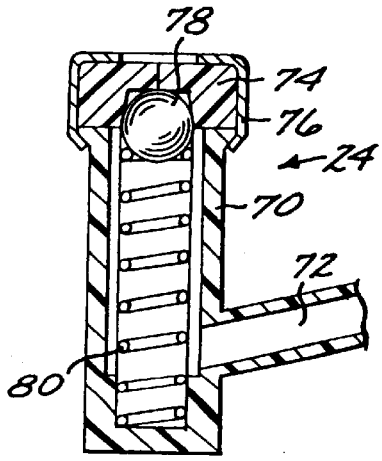
FIG. 7B
FIG. 7C
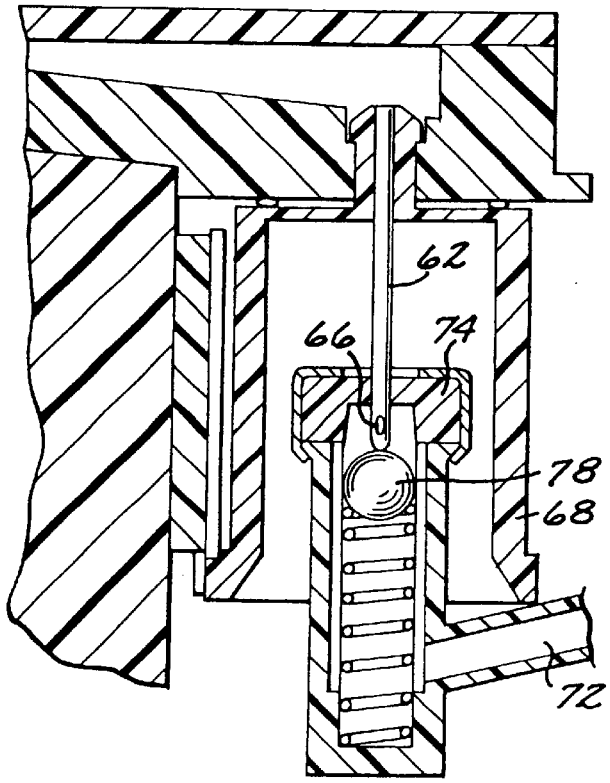

PRINTING SYSTEM WITH AIR ACCUMULATION CONTROL MEANS ENABLING A SEMIPERMANENT PRINTHEAD WITHOUT AIR PURGE

CROSS REFERENCE TO RELATED APPLICATIONS

This is a continuation of application Ser. No. 09/037,550 now U.S. Pat. No. 6,203,146, filed on Mar 9, 1998.

This application is related to commonly assigned applications: Patent Application "Printer Using Print Cartridge with Internal Pressure Regulator", Ser. No. 08/706051, filed Aug. 30, 1996, now U.S. Pat. No. 5,852,459, Patent Application "Ink-jet Printing System with Off-Axis Ink Supply and High Performance Tubing", Ser. No. 08/914832, filed Aug. 19, 1997, abandoned, Patent Application "Self-Sealing Fluid Interconnect with Double Sealing Septum, Ser. No. 08/566821, filed Dec. 4, 1995, now U.S. Pat. No. 5,777,646, and Patent Application "Anti-Outgassing Ink Composition and Method for Using the Same", Ser. No. 08/608922, filed Feb. 29, 1996, now U.S. Pat. No. 5,700,315, the entire contents of which are hereby incorporated by reference herein.

BACKGROUND OF THE INVENTION

This invention relates to inkjet printers and the like and, more particularly, to an inkjet printing system that makes use of a semipermanent printhead that does not require an air purge mechanism.

Inkjet printing systems frequently make use of an inkjet printhead mounted to a carriage which is moved back and forth across a print media, such as paper. As the printhead is moved across the print media, control electronics activate an ejector portion of the printhead to eject, or jet, ink droplets from ejector nozzles and onto the print media to form images and characters. An ink supply provides ink replenishment for the printhead ejector portion.

Some printing systems make use of an ink supply that is replaceable separately from the printhead. When the ink supply is exhausted the ink supply is removed and replaced with a new ink supply. The printhead is then replaced at or near the end of printhead life and not when the ink supply is exhausted. When a replaceable printhead is capable of utilizing a plurality of ink supplies, we will refer to this as a "semipermanent" printhead. This is in contrast to a disposable printhead, that is replaced with each container of ink.

A significant issue with semipermanent printheads is premature failure due to loss of proper pressure regulation. To understand this failure, we need to consider printhead operation. To operate properly, many printheads have an operating pressure range that must be maintained in a narrow range of slightly negative gauge pressure, typically between −1 and −6 inches of water. Gauge pressure refers to a measured pressure relative to atmospheric pressure. Pressures referred to herein will all be gauge pressures. If the pressure becomes positive, printing and printing system storage will be adversely affected. During a printing operation, positive pressure can cause drooling and halt ejection of droplets. During storage, positive pressure can cause the printhead to drool. Ink that drools during storage can accumulate and coagulate on printheads and printer parts. This coagulated ink can permanently impair droplet ejection of the printhead and result in a need for costly printer repair. To avoid positive pressure, the printhead makes use of an internal mechanism to maintain negative pressure.

Air present in a printhead can interfere with the maintenance of negative pressure. When a printhead is initially filled with ink, air bubbles are often left behind. In addition, air accumulates during printhead life from a number of sources, including diffusion from outside atmosphere into the printhead and dissolved air coming out of the ink referred to as outgassing. During environmental changes, such as temperature increases or pressure drops, the air inside the printhead will expand in proportion to the total amount of air contained. This expansion is in opposition to the internal mechanism that maintains negative pressure. The internal mechanism within the printhead can compensate for these environmental changes over a limited range of environmental excursions. Outside of this range, the pressure in the printhead will become positive.

One solution to the air accumulation problem has been the use of disposable printheads. The amount of ink associated with a disposable printhead can be adjusted to keep air accumulation below a critical threshold. When the amount of ink associated is small, this increases the cost of printing by requiring frequent printhead replacement. Alternatively, the ink container can be made large to reduce frequency of printhead replacement. However, large ink containers become problematic when the printing application is a compact desktop printer. An example of a system utilizing a disposable printhead, wherein a large ink supply is replaced each time the printhead is replaced, is described in U.S. Pat. No. 5,369,429, entitled "Continuous Ink Refill System for Disposable Ink Jet Cartridges Having a Predetermined Ink Capacity".

Another solution to the air accumulation problem has been the use of air purge mechanisms to make semipermanent printheads viable. An example of an air purge approach is described in U.S. Pat. No. 4,558,326, entitled "Purging System for Ink Jet Recording Apparatus". Issues with purging systems include the (1) added printer cost for the purge mechanism, (2) the reliability problems associated with accommodating the ink that tends to be purged out with air (that may increase printer maintenance requirements), and the (3) stranding of air in the ink ejectors of the printhead (when air is purged through the ink ejectors). In particular, air purge mechanisms can increase the maintenance requirements for a printer.

What is needed is a printing system utilizing a semipermanent printhead that makes use of techniques for delivering ink that are low cost, low maintenance, highly reliable, and enable a desktop printer of relatively compact size.

SUMMARY OF THE INVENTION

The present invention concerns an inkjet printing system including a semipermanent printhead having a fluid input for receiving ink and an ejection portion for depositing ink in response to control signals. The printing system also includes a replaceable ink supply configured for providing ink to the printhead that stores an ink volume. The printhead is capable of lasting throughout the life of a plurality of the ink volumes. The printing system includes a fluid accumulator portion in fluid communication with the printhead and the replaceable ink supply. The fluid accumulator is adapted to accommodate the air introduced into the printhead during the usage of the ink supplies without purging air from the printhead.

A preferred embodiment of the invention concerns an ink delivery apparatus that fluidically couples to the fluid input and provides ink to the printhead. This ink delivery apparatus is adapted to control air introduction to the printhead such that the accumulator portion can accommodate all air introduced during the life the printhead.

BRIEF DESCRIPTION OF THE DRAWINGS

FIG. 7A illustrates an isometric view of the printhead poised for connection to the conduit outlet of the present invention.

FIG. 7B is a cross sectional representation of the conduit outlet taken through section 7B—7B of FIG. 7A.

FIG. 7C is a cross sectional representation of the fluidic connection between the printhead and the conduit outlet of the resent invention taken through section 7B—7B of FIG. 7A.

DETAILED DESCRIPTION OF THE PREFERRED EMBODIMENT

Figure 1:
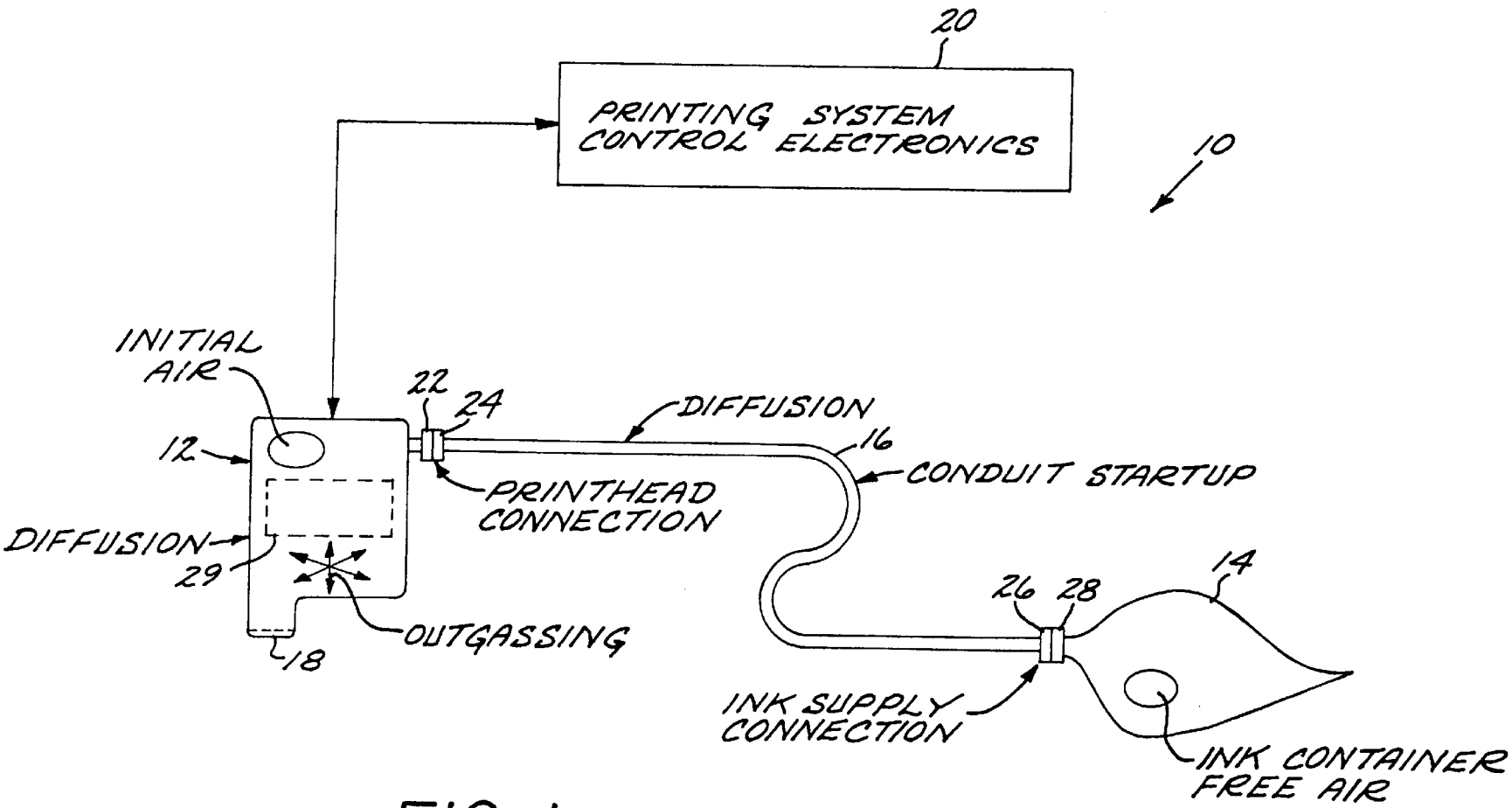
FIG. 1 depicts a schematic representation of a printing system of the present invention and includes an indication of the sources of air affecting the printing system.

FIG. 1 is a schematic representation which depicts an inkjet printing system 10 of the present invention. Printing system 10 includes a printhead 12 that is fluidically coupled to a replaceable ink supply or container 14 via a fluid conduit 16.

Printhead 12 receives ink from fluid conduit 16 to allow ejector portion 18 to selectively deposit inks onto media (not shown) under control of printing system control electronics 20. Printhead 12 includes a fluid inlet 22 that is fluidically connected to a conduit outlet 24 associated with fluid conduit 16.

The fluid conduit 16 receives ink from replaceable ink supply 14. Fluid conduit 16 includes a conduit inlet 26 that is fluidically coupled to a fluid outlet 28 associated with replaceable ink supply 14.

During a printing operation, ink flows from ink supply 14, through conduit 16, and to printhead 12 so that ink droplets can be ejected by nozzles (not shown) associated with ejector 18. Because printhead 12 is semipermanent, it is capable of printing a large volume of ink. Thus, ink supply 14 is periodically replaced. In an exemplary embodiment, printhead 12 is expected to last while 450 cc (cubic centimeters) of ink is printed. In this embodiment, each ink supply 14 provides 30 cc of ink to printhead 12, such that printhead 12 is expected to last during the use of 15 ink supplies.

An aspect of the invention concerns the techniques used to limit air accumulation and to accommodate air that accumulates in printing system 10. As indicated by FIG. 1 and below, printing system 10 has a number of sources of air that ultimately accumulate in printhead 12.

1) Initial Air—This refers to air bubbles present before printhead 12 is installed into printing system 10.
2) Printhead Connection—This refers to air introduced when printhead 12 is connected to conduit 16.
3) Conduit Startup—This refers to air initially present in conduit 16 that is flushed into printhead 12 when the printing system 10 is initially used.
4) Diffusion—This refers to air that diffuses into printhead 12 and conduit 16 during the life of printhead 12.
5) Ink Supply Connection—This refers to air introduced when each ink supply 14 is connected to conduit 16.
6) Ink Container Free Air—This refers to air bubbles present in ink supply (container) 14 that get drawn into conduit 16 and subsequently into printhead 12 via fluid flow.
7) Outgassing—This refers to air that comes out of solution as ink passes through printhead 12.

Another aspect of this invention is an accumulator mechanism that allows printhead 12 to accommodate air introduced into printing system 10 by the sources above prevent drooling from printhead 12, it is critical that printhead 12 maintain an internal negative pressure. When printhead 12 experiences an environmental temperature and pressure excursion during periods of non-printing, bubbles inside printhead 12 will tend to expand, increasing the pressure in printhead 12. The printhead includes an accumulator 29 that compensates for this expansion to maintain the negative pressure. However, the accumulator has an upper limit volume for which it can compensate. This is referred to as the "warehouse capacity" for air.

The "warehouse capacity" of the accumulator 29 is determined by the accumulator design and an environmental operating range. This environmental range is defined by upper limit of temperature and/or a lower limit of pressure at which the accumulator 29 must accommodate a maximum amount of bubble expansion. In an exemplary embodiment, this upper limit is a temperature of 140° F. (degrees Fahrenheit) at a constant pressure. Thus, the accumulator must accommodate expansion of a volume of air equal to the warehouse capacity up to a temperature of 140° F. In an exemplary embodiment, the warehouse capacity is 4.5 cc (cubic centimeters). In other words, this exemplary accumulator must compensate for the expansion of a 4.5 cc bubble from ambient (approximately 70° F.) to 140° F. while maintaining a negative pressure in the plenum.

Another aspect of this invention concerns an "air budget" that is selected to insure that the sources of air do not exceed the warehouse capacity. Within the air budget, we select how much air we will allocate for each source of air. An exemplary air budget is tabulated in Table 1 below:

TABLE 1

Exemplary Air Budget

| Air Budget Items, by source of air | Air Budget Value |
|---|---|
| Initial | 0.3 cc |
| Printhead Connection | 0.1 cc |
| Conduit Startup | 1.3 cc |
| Diffusion (tubing, printhead) | 1.0 cc |
| Ink Supply Connection | 0.1 cc |
| Ink Supply (Container) Free Air | 0.1 cc |
| Outgassing | 1.6 cc |

Air Budget total = 4.5 cc

The sum of all budget items equals the warehouse capacity of 4.5 cc. Any single budget item can increase provided other item(s) are correspondingly decreased to assure that the air budget total does not exceed the air warehouse capacity.

Another aspect of the invention concerns techniques used to insure that each source of air is maintained at a low enough level to keep the total air accumulated below the warehouse level. The techniques to accommodate air and limit air introduction will be discussed below with respect to FIGS. 2–13.

Figure 2:
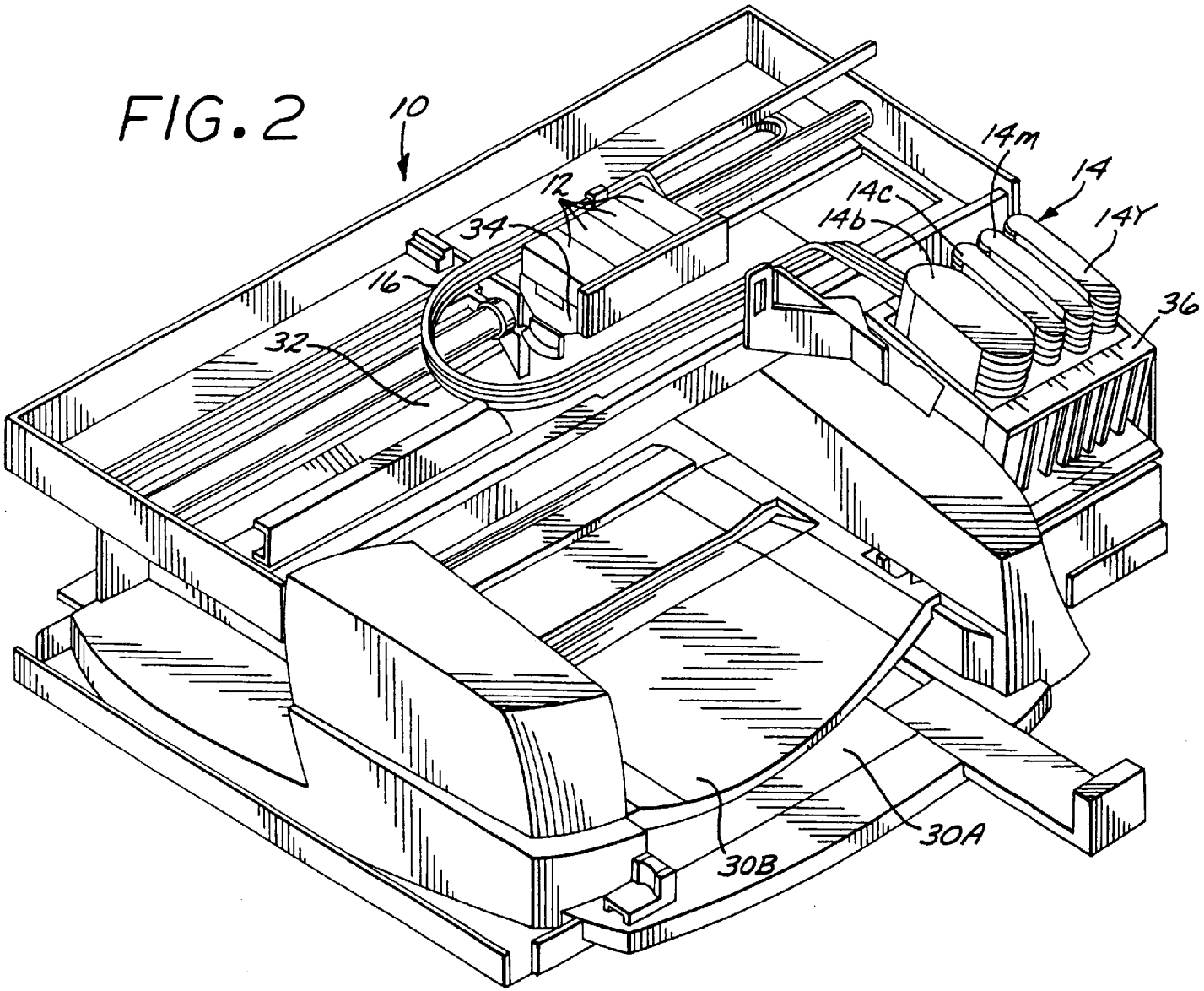
FIG. 2 is a representation, shown in perspective of a preferred embodiment of a printer that utilizes the present invention.

FIG. 2 depicts a representation of one preferred embodiment of printing system 10. The printing system 10 includes media input 30A and output 30B trays for storing media (not shown) both before and after, respectively, the media is fed through a print zone 32. A carriage 34 supports a plurality of printheads 12 and scans over print zone 32 to allow a plurality of ejectors 18 associated with printheads 12 to selectively deposit ink on the media. Each printhead 12 receives ink from one of a plurality of corresponding ink supplies 14 via conduits 16.

Printheads 12 are semipermanent, since they can each utilize a plurality of ink containers 14. This allows printing system 10 to be of compact size. Ink supplies 14 of this preferred embodiment utilize different colorant inks, including black 14*b*, cyan 14*c*, magenta 14*m*, and yellow 14*y*. The black ink container 14*b* has a capacity of approximately 75 cc, and the color ink containers 14*c*, 14*m*, and 14*y* each have capacities of approximately 30 cc. There is also a 30 cc black ink container that is plug compatible with the larger 75 cc black ink container. The sizes of the ink containers are chosen small enough to avoid impacting the size of printing system 10 and to take shelf life considerations into account. They are selected large enough to allow for an acceptably low replacement rate. Since each printhead 12 can last throughout the usage of approximately 450 cc of ink, each printhead must utilize a plurality of ink containers 14, and hence, must be semipermanent.

Figure 3:
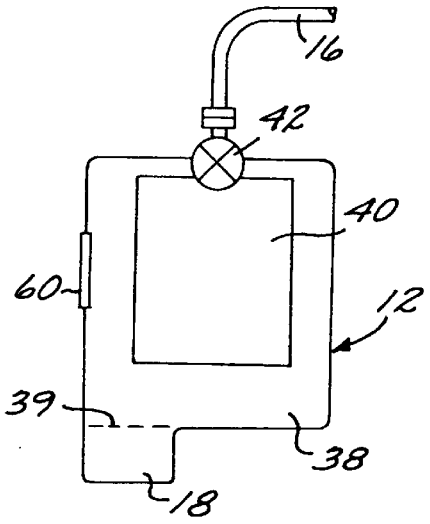
FIG. 3 is a schematic representation of a preferred embodiment of a printhead of the present invention.

The warehouse capacity of printhead 12 will now be discussed with respect to FIGS. 3, 4, and 5A–C. FIG. 3 illustrates a schematic representation of printhead 12 connected to fluid conduit 16. Printhead 12 receives ink from fluid conduit 16 at an incoming pressure and then delivers the ink to ejector 18 at a controlled internal pressure that is lower than the incoming pressure. Ejector 18 is fluidically coupled to a plenum 38 that stores a quantity of ink at the controlled internal pressure. Ink passes through filter element 39 before reaching ejector 18 to remove particulates.

The negative pressure in plenum 38 is controlled using a regulator that includes actuator 40 and valve 42. As the ejector 18 deposits ink on media, the ink in plenum 38 is depleted. This decreases the internal pressure in plenum 38. When the internal pressure reaches a low pressure threshold, actuator 40 responds by opening valve 42, allowing ink to pass from fluid conduit 16 to plenum 38. This introduction of ink raises the pressure of plenum 38. When the internal pressure reaches a high pressure threshold, actuator 40 responds by closing valve 42. Thus, the pressure in plenum 38 is regulated between the low pressure and the high pressure thresholds.

Figure 4:
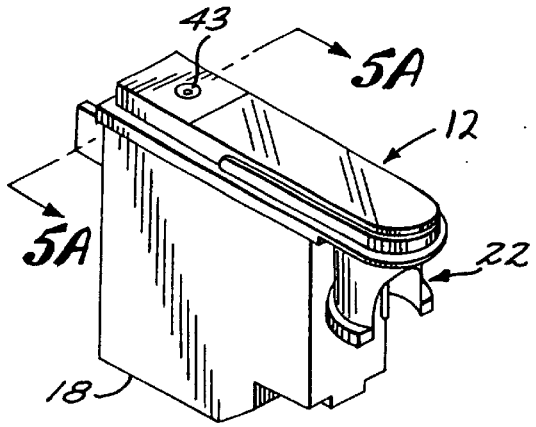
FIG. 4 illustrates an isometric view of a preferred embodiment of the printhead of the present invention.

FIG. 4 illustrates an isometric view of a preferred embodiment of printhead 12. Printhead 12 includes fluid inlet 22 for receiving ink from conduit 16 and ejector portion 18 for selectively depositing ink on media (not shown). Printhead 12 also includes an internal regulator that is discussed with respect to FIGS. 3 and 5A–C. The internal regulator includes an air conduit 43 that will be discussed with respect to FIGS. 5A–C.

Figure 5A:
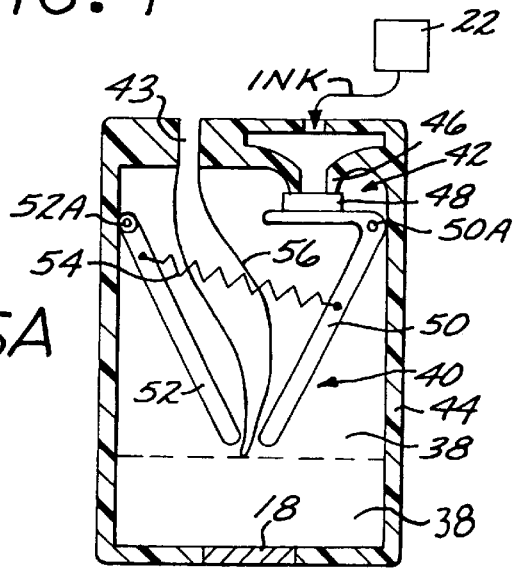
FIGS. 5A–5C are cross sectional schematic representations taken through section 5A—5A from FIG. 4.
Figure 5B:
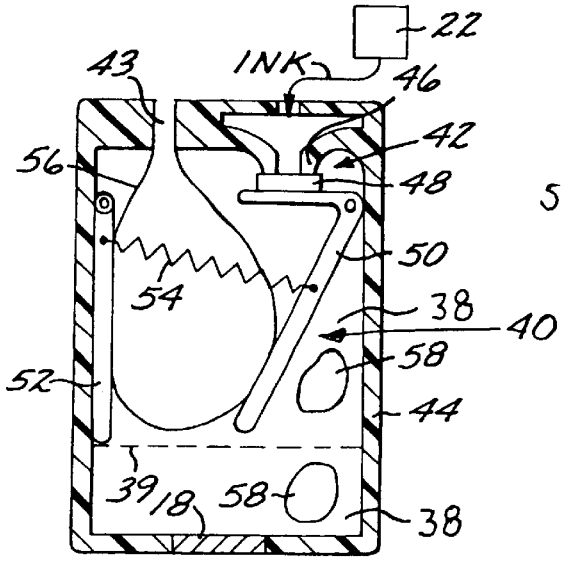
Figure 5C:
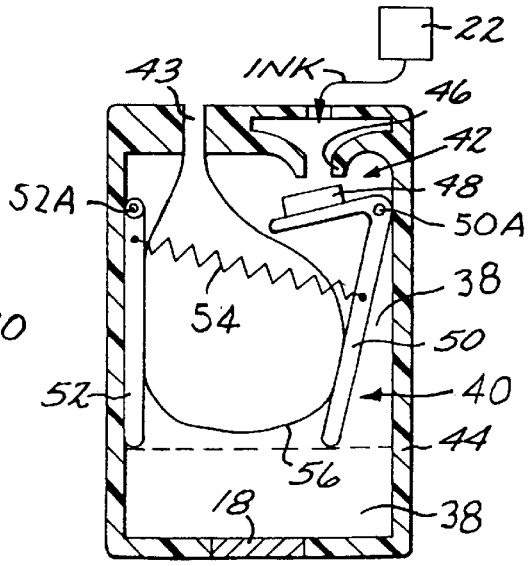

FIGS. 5A–5C are cross sectional schematic representations of printhead 12 taken through section 5A—5A from FIG. 4. The internal structure of printhead 12 is simplified to more clearly illustrate functional aspects of the pressure regulation system in printhead 12. In comparing FIGS. 5A–C and 3, similar element numbering is used to identify similar elements.

Printhead 12 includes an outer housing 44 that supports ejector portion 18. In fluid communication with ejector portion 18 is plenum 38. Inside plenum 38 is the actuator 40 and valve 42 for selectively allowing ink into plenum 38.

Valve 42 includes a nozzle 46 that is fluidically connected to fluid inlet 22 for allowing ink to enter plenum 38 and a valve seat 48 for sealing nozzle 46. Valve seat 48 is formed of a resilient material to assure reliable sealing of valve 42. Valve seat 48 is fixedly mounted to a pressure regulator lever 50 that rotates about a regulator axle 50A. Rotation of lever 50 opens and closes valve 42 based upon changes in pressure in plenum 38, as illustrated in FIGS. 5A–C.

Printhead 12 also includes an accumulator lever 52 that rotates about an accumulator axle 52A. A spring 54 connects the regulator valve lever 50 to the accumulator lever 52, and biases the levers toward each other. The spring is connected relatively closer to accumulator axle 52A than to regulator axle 50A.

An expandable bag 56 is located between the accumulator lever 52 and the regulator lever 50. A first surface of the expandable bag 56 communicates with outside atmosphere via air conduit 43, and a second surface of the bag 56 is in contact with ink in plenum 38. Thus, the bag 56 expands and contracts in response to pressure differences between the plenum 38 and outside atmosphere. Together, the bag 56, the regulator lever 50, and the spring 54 function as the actuator 40 as was discussed with respect to FIG. 3.

FIG. 5A illustrates an initial state of printhead 12 when bag 56 is fully collapsed. When printing commences bag 56 expands to compensate for the volume of ink ejected by ejector 18. The bag volume increases until it begins pressing on accumulator lever 52 on one side, and regulator lever 50 on the other side, opposing the force exerted by spring 54. When the pressure in bag 56 is high enough, the levers begin to pivot outwardly in opposition.

The accumulator lever 52 moves first, since the moment exerted by spring 54 on accumulator lever 52 is less than the moment exerted by spring 54 on regulator lever 50. The accumulator lever moves until it contacts outer housing 44, as indicated by FIG. 5B.

When the accumulator lever 52 is fully extended, the regulator lever 50 begins to move, until valve seat 48 is lifted away from nozzle 46, opening valve 42, as shown in FIG. 5C. Then ink flows from conduit 16, through nozzle 46, and into plenum 38. The incoming ink increases the pressure in plenum 38, reducing the force of bag 56 on the levers 50 and 52, and allowing valve 42 to close. Printhead 14 is then in the state illustrated with respect to FIG. 5B.

As discussed before, it is important that negative pressure be maintained in plenum 38. The accumulator functions to maintain this negative pressure even with air present in plenum 38. Because of the relative attachment points of spring 54, the accumulator lever remains pressed against housing 44 during normal operation. Over printhead life, air bubbles 58 tend to accumulate in printhead 12. During storage and idle periods of printing system 10, environmental temperatures can vary. According to the ideal gas law, bubbles 58 expand in response to a rising temperature, causing bag 56 to collapse in response. As bag 56 collapses, accumulator lever 52 then moves to maintain pressure on bag 56. The accumulator lever 52 and bag 56 thereby assure a constant negative pressure in printhead 12 to prevent positive pressure throughout the accumulator lever 52 range of motion.

In an exemplary system, the range of motion of accumulator lever 52 allows for up to a warehouse capacity of 4.5 cc of accumulated air in plenum 38 while maintaining a negative pressure in plenum 38 over the specified environmental operating range. If the accumulated air exceeds 4.5 cc, then printhead 12 may drool, causing printhead and printer damage and affecting operation of ejector 18. Thus, the cumulative volume of all sources of air should be kept below 4.5 cc, the warehouse volume.

There are other ways of providing a pressure regulator and accumulator. Referring back to FIG. 3, valve 42 could be an electromechanical valve, such as a solenoid valve. The actuator 40 could be a pressure transducer that provides signals to a circuit for opening and closing valve 42. To provide a capacity to accumulate air, the outer walls of plenum 38 should be at least partly compliant. One way to do this is to provide a rubber diaphragm 60 that separates plenum 38 from an outside atmosphere that can move in response to bubble expansion; thus diaphragm 60 is functioning as the accumulator 29. Alternatively, plenum 38 can be surrounded by a spring loaded bag that similarly functions as an accumulator 29. Each alternative accumulator design will have its own air accumulation limits and hence warehouse capacity. To avoid the deleterious effects of positive pressure, the sum of the sources of air must be kept below this warehouse capacity.

The sources of air and techniques used to maintain them within their respective budgets will now be discussed with respect to FIGS. 6–13. Budgeting and controlling each source to meet overall budget goals are important aspects of this invention.

The first source of air is the initial air present in printhead 12 before it is installed into printing system 10. In an exemplary embodiment, 0.3 cc of air is budgeted for this source, which includes air introduced by manufacturing processes, air that diffuses into printhead 12 between manufacturing and installation of printhead 12 into printing system 10, and air that is drawn into printhead 12 through the fluid inlet 22 or the ejector portion 18. To minimize these values, a number of design and assembly methods are utilized for fabricating printhead 12 as will be discussed below.

When printhead 12 is manufactured, air is introduced as printhead 12 is filled with ink. To minimize such air, the following ink fill process is used: (1) Printhead 12 is initially flushed with CO2 gas by providing a source of CO2 gas at the fluid inlet 22 and by providing a vacuum source at the ejector 18 of printhead 12 until nearly all of the gas resident in printhead 12 is composed of CO2. (2) Next, printhead 12 is filled with degassed ink (ink having less than the saturation level of dissolved oxygen) by providing a source of degassed ink at the fluid inlet 22 and a source of vacuum at ejector 18 until printhead 12 is filled with ink. Any bubbles left behind during the fill process will be primarily composed of CO2 and will quickly dissolve in the ink. Further, any impurities in the bubbles (such as air) will be absorbed by the ink, since it is degassed.

Printhead 12 is also fabricated with high air diffusion barrier materials to minimize diffusion of air into printhead 12 between the ink fill process and installation of printhead 12 into the printer. In a preferred embodiment, the outer housing 44 of printhead 12 is fabricated from LCP (liquid crystal polymer). Other high barrier materials will also work effectively, such as PET (polyethylene terephthalate) or metallized plastic. The bag 56 is preferably formed from a multilayer plastic film, with at least one layer having a high air diffusion barrier property. A preferred high barrier material is PVDC (polyvinylidene chloride). Other layers are utilized to maximize adhesion and flexibility, such as LDPE (low density polyethylene).

Figure 6:
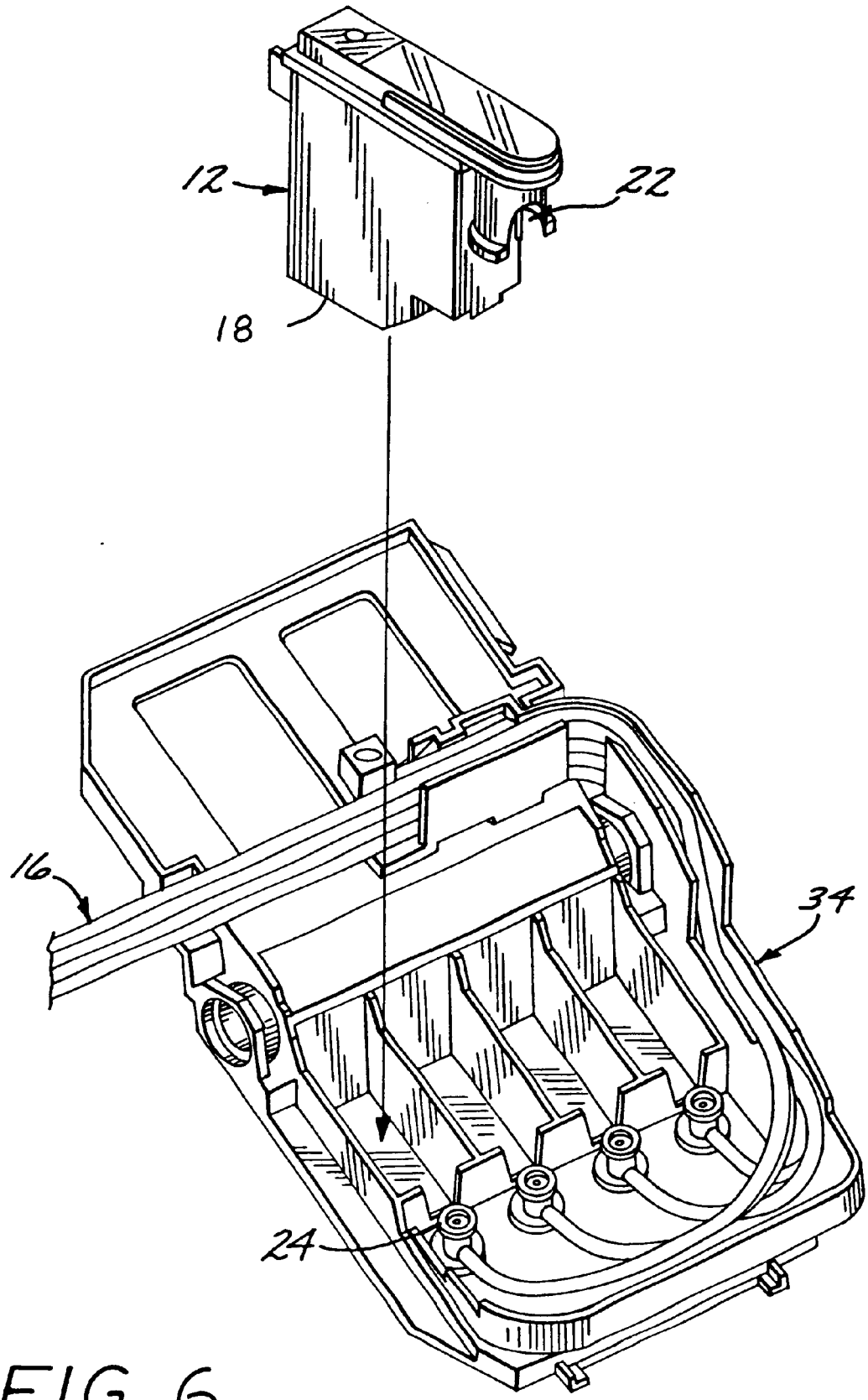
FIG. 6 illustrates an isometric view of a printhead poised for insertion into a carriage portion of a printing system of the present invention.

Illustrated with respect to FIGS. 6 and 7, a second source of air is introduced when a "printhead connection" is established between conduit outlet 24 and fluid inlet 22. FIG. 6 illustrates the initial installation of printhead 12 into carriage 34. Printhead 12 is installed into carriage 34 by inserting it in a substantially downward motion. Upon insertion, conduit outlet 24 connects to fluid inlet 22 associated with the printhead 12.

Details of the fluid connection between fluid inlet 22 and conduit outlet 24 are further illustrated with respect to FIGS. 7A–C. FIG. 7A illustrates the printhead 12 poised for fluidic connection to the conduit outlet 24. FIG. 7B illustrates the conduit outlet 24 prior to the fluidic connection. FIG. 7C illustrates the completed fluidic connection between fluid inlet 22 and conduit outlet 24.

The fluid inlet 22, associated with the printhead 12, includes a downwardly extending hollow needle 62 having a closed, blunt lower end, a blind bore (not shown) and a lateral hole 66. The blind bore is fluidically connected to the nozzle 46 previously illustrated in FIGS. 5A–C and to the lateral hole 66. The needle 62 is surrounded by a shroud 68.

The conduit outlet 24 includes a hollow cylindrical housing 70 that extends upward. The hollow housing 70 has an inlet 72 in fluid communication with conduit 16. The hollow housing 70 has an upper end supporting a pre-slit septum 74 that is secured to housing 70 by a crimp cap 76. A sealing member 78 is urged against the septum 74 by a spring 80.

When printhead 12 is installed into carriage 34, the shroud 68 helps to align the septum 74 to the needle 62. The upper end of the conduit inlet 24 is sized to properly engage fluid inlet 22. The diameter of the upper end of conduit inlet 24 should be small enough to be received by shroud 68, but large enough to control alignment variation between fluid inlet 22 and conduit outlet 24 to assure a reliable fluidic connection between needle 62 and septum 74. During fluidic connection, needle 62 passes through the septum 74 to displace the sealing member 78 down into the cylindrical housing 70. Thus, in the final inserted position, ink can flow from conduit 16, into housing inlet 72, around the sealing member 78, into lateral hole 66, into the blind bore, and into nozzle 46 (FIGS. 7A–C).

To stay within the air budget, it is important that fluidic disconnection and reconnection between conduit outlet 24 and fluid inlet 22 introduce a minimal amount of air to printhead 12. If printhead 12 is disconnected from conduit 16, there may be a negative pressure present in conduit 16 that would tend to draw air into conduit outlet 24. To prevent this, septum 74 immediately self-seals after needle 62 is withdrawn, preventing air from entering conduit 16. After extended usage, however, septum 74 may take on a compression set such that it does not immediately self seal when disconnected from the needle 62. To assure an immediate and reliable seal, sealing member 78 provides a redundant seal of conduit outlet 24. The air budget of TABLE 1 allocates 0.1 cc of air for this fluidic disconnection and reconnection, but the actual air introduced is insignificant for printhead 12 because of the reliable self-sealing nature of conduit outlet 24.

A third source of air is air present in conduit 16 when the printhead 12 is initially installed, referred to as "tubing startup" air. In an exemplary embodiment, this provides no more than 1.3 cc of air to printhead 12. Referring back to FIG. 1, fluid conduit 16 may be initially unprimed (empty) to address reliability issues. For example, during shipment from manufacturing site to customer, printing system 10 can experience temperature fluctuations that may cause freezing and expansion of any ink in fluid conduit 16 which could cause damage to fluid conduit 16. For this reason, fluid conduit 16 is initially shipped dry from the factory.

A fourth source of air is diffusion of air from outside into conduit 16 and into printhead 12 while printhead 12 is installed in printing system 10. In an exemplary embodiment, the total diffusion is kept to 1.0 cc or less by the use of high air diffusion barrier materials for fabricating the printhead and the conduit. As discussed above, the printhead is fabricated of high diffusion barrier polymers. The fluid conduit includes tubing fabricated of a low air diffusion material, with an oxygen permeability characteristic of less than 100 cc·mil/ (100 $in^2$·day·atm) at 23° C. (degrees Celsius) 0% Rh (relative humidity). Examples of flexible polymers suitable for this tubing include PVDC (polyvinylidene chloride copolymer), ECTFE (ethylenechlorotrifluoroethylene), and PCTFE (polychlorotrifluoroethylene) copolymer.

Figure 8:
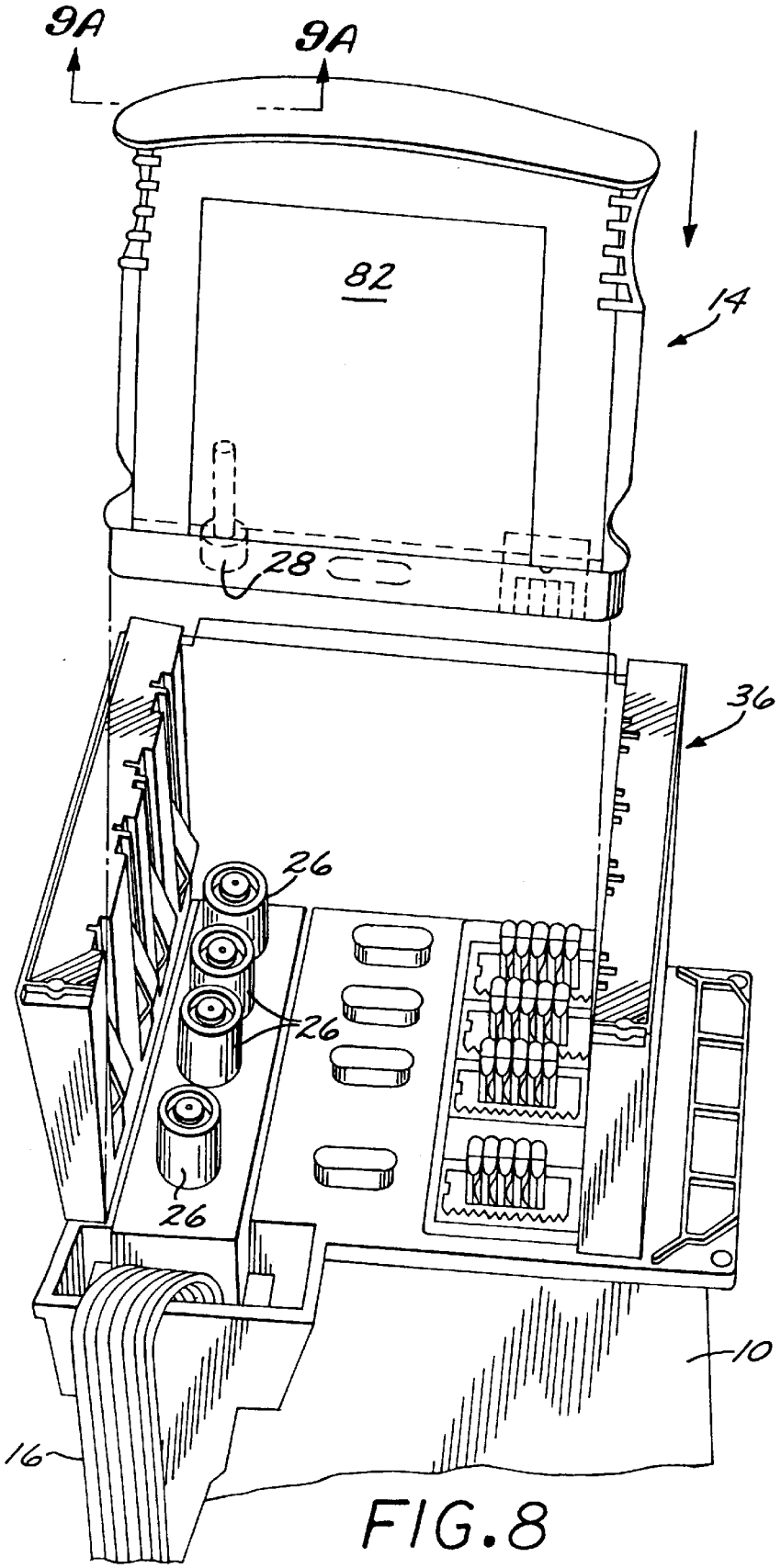
FIG. 8 is an ink supply receiving station of the type used in the printing system of FIG. 2, shown broken away, with an ink supply positioned for insertion into the ink supply receiving station.
Figure 9A:
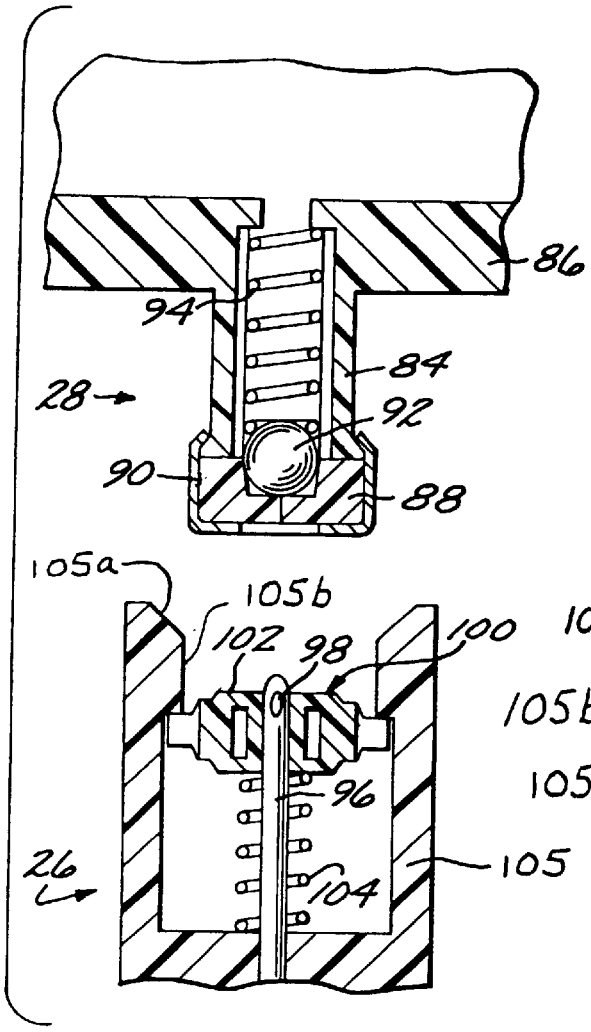
FIG. 9A is a cross sectional representation of the fluid outlet and the conduit inlet taken through section line 9A—9A of FIG. 8 prior to a fluidic connection between the fluid outlet and the fluid inlet.
Figure 9B:
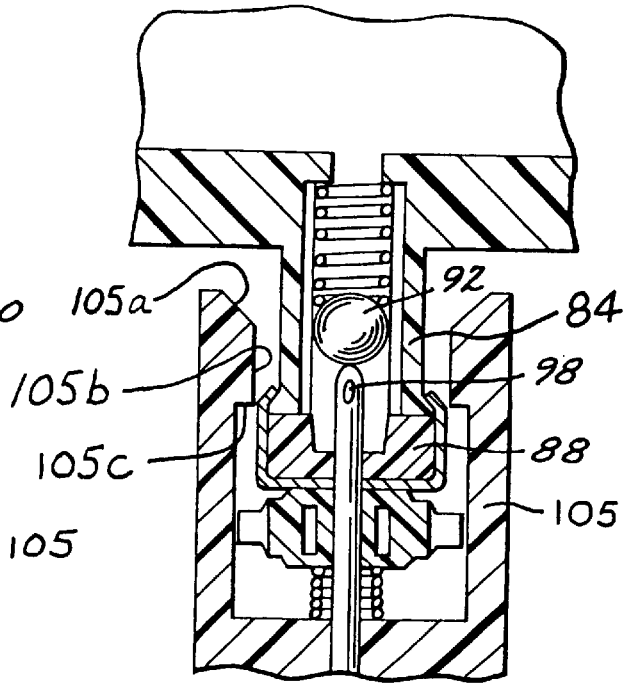
FIG. 9B is a cross sectional representation of the fluidic connection between fluid outlet and the conduit inlet taken through line 9A—9A of FIG. 8.

A fifth source of air, illustrated with respect to FIGS. 8, 9A, and 9B, is the ink supply connection between ink supply 14 and conduit 16. FIG. 8 illustrates ink supply 14 poised for substantially downward insertion into receiving station 36, leaving out details that do not pertain to the invention. Ink supply 14 includes a fluid reservoir 82 that is in fluid communication with fluid outlet 28. When ink supply 14 is releasably inserted in receiving station 36, fluid outlet 28 couples with conduit inlet 26 to allow ink to flow from fluid reservoir 82 to conduit 16 and to printhead 12 (FIG. 1).

The ink supply connection is further illustrated with respect to FIGS. 9A and 9B, which are cut-away cross sectional representations taken through line 9A—9A of FIG. 8 that include only the fluidic connection. FIG. 9A illustrates fluid outlet 28 and conduit inlet 26 prior to fluidic connection.

Fluid outlet 28 associated with ink supply 14 includes a hollow cylindrical boss 84 that extends downward from an ink supply chassis 86. The hollow boss 84 has an upper end in fluid communication with reservoir 82 and a lower end supporting pre-slit septum 88 that is secured to boss 84 by crimp cap 90. A sealing member 92 is urged against septum 88 by spring 94.

Conduit inlet 26 includes an upwardly extending hollow needle 96 having a closed, blunt upper end, a blind bore (not shown) and a lateral hole 98. The blind bore is fluidically connected to the lateral hole 98. The end of the needle 96 opposite the lateral hole 98 is fluidically connected to conduit 16 for providing ink to printhead 12. A sliding collar 100 surrounds the needle 96 and includes a compliant portion 102. The sliding collar 100 is biased upwardly by spring 104 to maintain a position whereby complaint portion 102 seals lateral hole 98 from an outside atmosphere.

Conduit outlet 26 also includes an upwardly extending boss 105 that surrounds sliding collar 100. Upwardly extending boss 105 provides protection for needle 96, retention for sliding collar 100, and an alignment function for fluid outlet 28.

FIG. 9B illustrates the fluidic connection between fluid outlet 28 and conduit inlet 26. When ink supply 14 is installed into receiving station 36, the lower or distal end of the fluid outlet 28 first engages a tapered portion 105*a* and an inner surface 105*b* of boss 105 and is guided into alignment with needle 96. The lower end of fluid outlet 28 then pushes the sliding collar 100 downward. Simultaneously, the needle 96 enters the septum 88 and passes through the septum 88 to displace the sealing member 92 up into the cylindrical boss 84. Thus, in the fully inserted position, ink can flow from the ink supply reservoir 82, through the boss 84, around the sealing member 92, into the lateral hole 98, to the fluid conduit 16 and to printhead 12.

Upon removal of ink supply 14, the septum 88 is withdrawn from hollow needle 96 to allow the fluid outlet 28 and conduit inlet 26 to return to the condition illustrated with respect to FIG. 9A.

Fluid outlet 28 is sized to reliably engage fluid inlet 26 to avoid introduction of air to conduit 16. Fluid outlet 28 should be of sufficient length to properly engage sliding collar 100 and to push sliding collar 100 sufficiently far from lip 105*c* to assure connection between lateral hole 98 and the inside of hollow boss 84. The lower end of fluid outlet 28 should have a sufficiently small diameter to be received in boss 105, but large enough to control alignment variation between needle 96 and septum 88 when engaging the tapered portion 105*a* and the inner surface 105*b* of boss 105.

Because a plurality of ink supplies are connected and disconnected to conduit inlet 26, it is very important that fluidic disconnection and reconnection between conduit inlet 26 and fluid outlet 28 introduce a minimal amount of air to conduit 16. When ink supply 14 is disconnected from conduit 16, there may be a slight negative pressure present in conduit 16 that would tend to draw air into conduit inlet 26. To prevent this, sliding collar immediately seals lateral hole 98 when ink supply 14 is disconnected. On the fluid outlet side, septum 88 and sealing member 92 immediately self-seal, preventing air from being drawn into ink supply 14. This is important if ink container 14 is removed and reinstalled to prevent air introduction. The air budget of TABLE 1 only allocates 0.1 cc of air of air for ink supply 14 connection over the life of printhead 12.

A sixth source of air is "ink supply (container) free air", or bubbles in the ink supply 14 that are drawn from the ink supply 14, through conduit 16, and into printhead 12. This free air is initially present in reservoir 82 and/or fluid outlet 28. In an preferred embodiment, ink supply 14 is installed in a substantially vertical orientation as depicted in FIG. 8. Any free air will tend to buoyantly rise to an upper portion of ink supply 14. Because of this arrangement, the "ink supply free air" contribution to the air budget is 0.1 cc.

However, if sufficient free air is present in ink supply 14, it may still be delivered to conduit 16 when ink supply 14 is nearly depleted of ink. Thus, it is desirable to limit the total volume of air bubbles that can accumulate in ink container 14.

Figure 10:
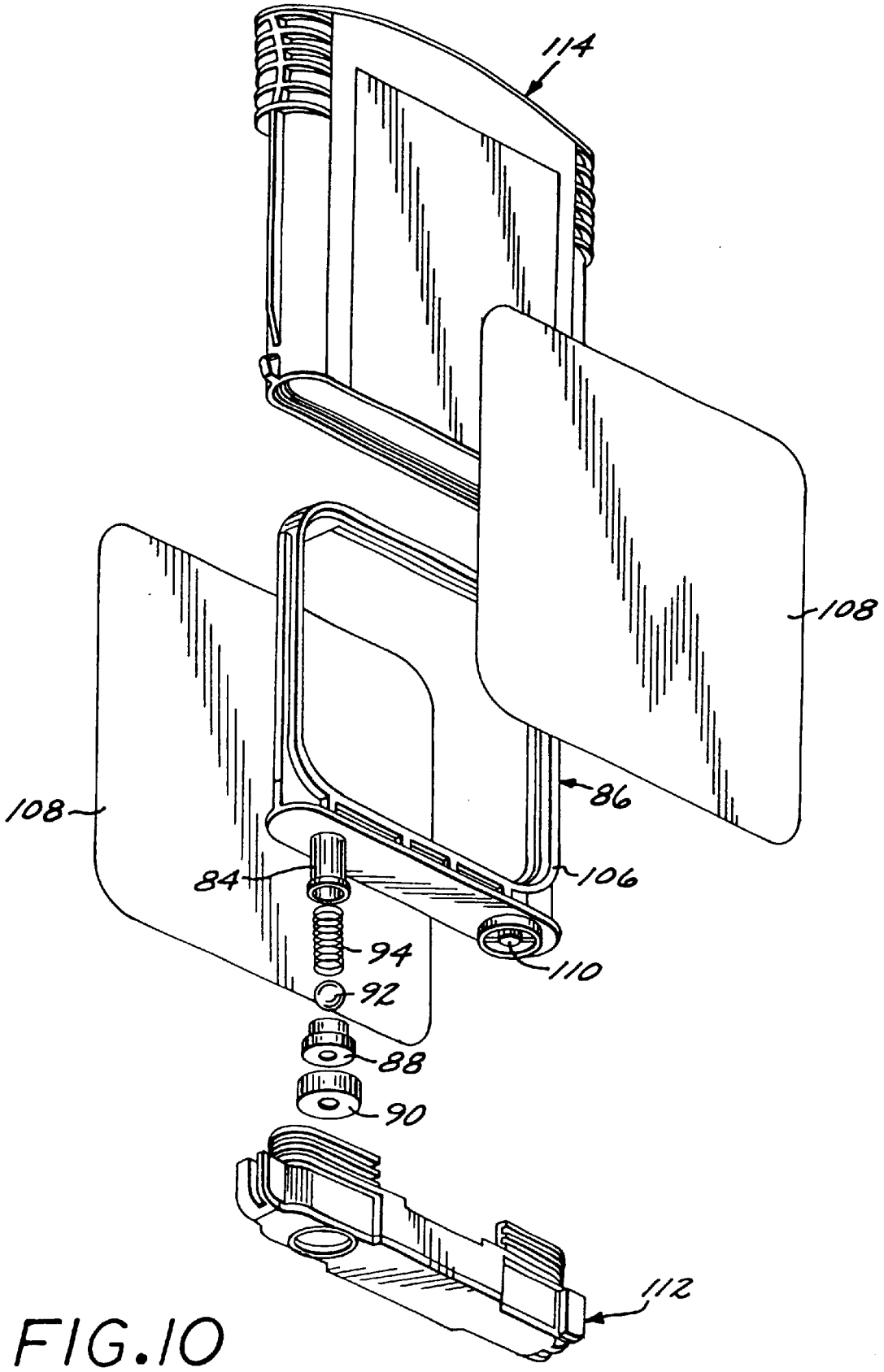
FIG. 10 illustrates an isometric exploded view of the parts of a preferred embodiment of ink container 10 prior to assembly of ink container 10.
Figure 11:
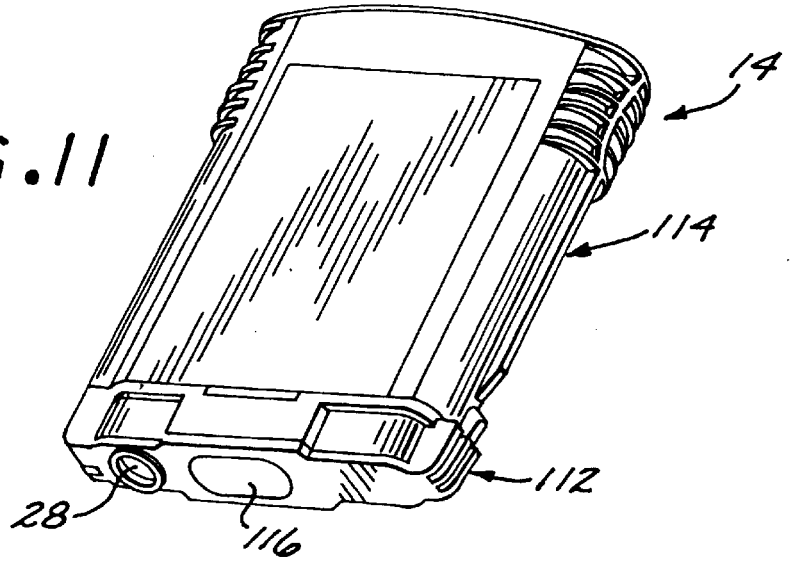
FIG. 11 illustrates an isometric view of a preferred embodiment of ink container 10.

Ink supply free air is affected primarily by the ink supply materials and fabrication processes. FIGS. 10 and 11 show a exploded and fully assembled views of a preferred embodiment of ink supply 14, leaving out details that do not pertain to the invention. Referring to FIG. 10, assembly of ink supply 14 includes the following steps:

1. Provide chassis 86 that includes outwardly extending fluid-outlet boss 84 and perimetrical sealing surfaces 106.
2. Attach and seal film sheets 108 to perimetrical sealing surfaces 106 to form reservoir 82. Film sheets are of a high air diffusion barrier multilayer construction. In a preferred embodiment, the layers include nylon, metallized (silver) PET, and LDPE.
3. Assemble spring 94, sealing member 92, pre-slit septum 88, and crimp cap 90 to boss 84 to form fluid outlet 28.
4. CO2 flush ink supply by injecting CO2 into a fill port 110 and evacuating through fill port 110. This process of injecting CO2 and evacuating can be repeated until reservoir 82 is substantially free of residual air.
5. After evacuating through fill port 110, fill ink supply with degassed ink through fill port 110.
6. Immediately seal fill port 110.
7. Enclose ink supply in cap 112 and shell 114. The resultant assembled ink supply 14 is illustrated with respect to FIG. 9.

The process described above minimizes initial and accumulated free air in two major respects. First, as discussed with respect to printhead 12, the CO2 flush and degassed ink fill process effectively eliminates initial free air that is present ink supply 14. Second, the material choice for film sheets 108 minimizes diffusion of air into the fluid reservoir 82, keeping the accumulated air below the threshold wherein air would begin to be delivered to conduit 16.

A seventh source of air accumulation in printhead 12 is outgassing. The mechanism for this outgassing is a solubility change that occurs as ink passes through plenum 38 of printhead 12. As ink enters plenum 38, the solubility of dissolved air in the ink decreases, causing diffusion of air from the ink into bubbles present in plenum 38. This solubility decrease is primarily temperature-induced, as will be explained now.

Figure 12:
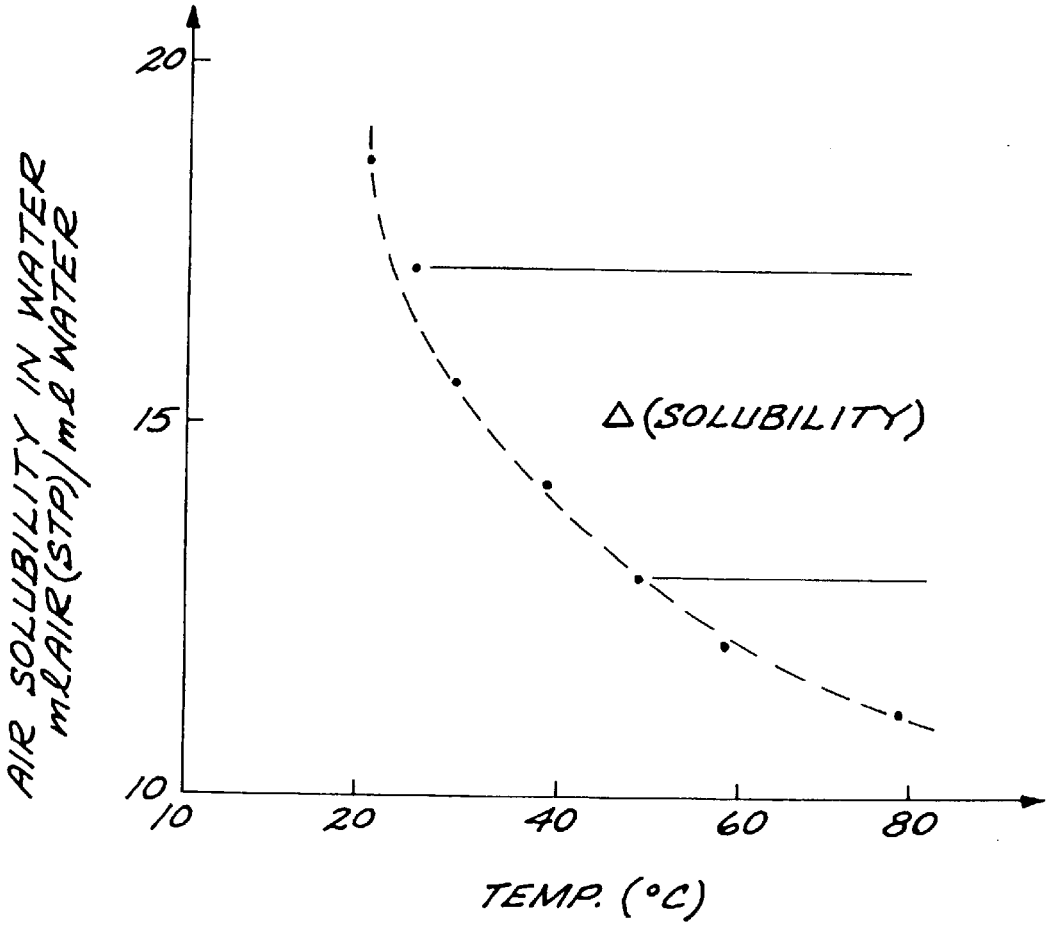
FIG. 12 is a plot of the solubility of air in water versus temperature.
Figure 13:
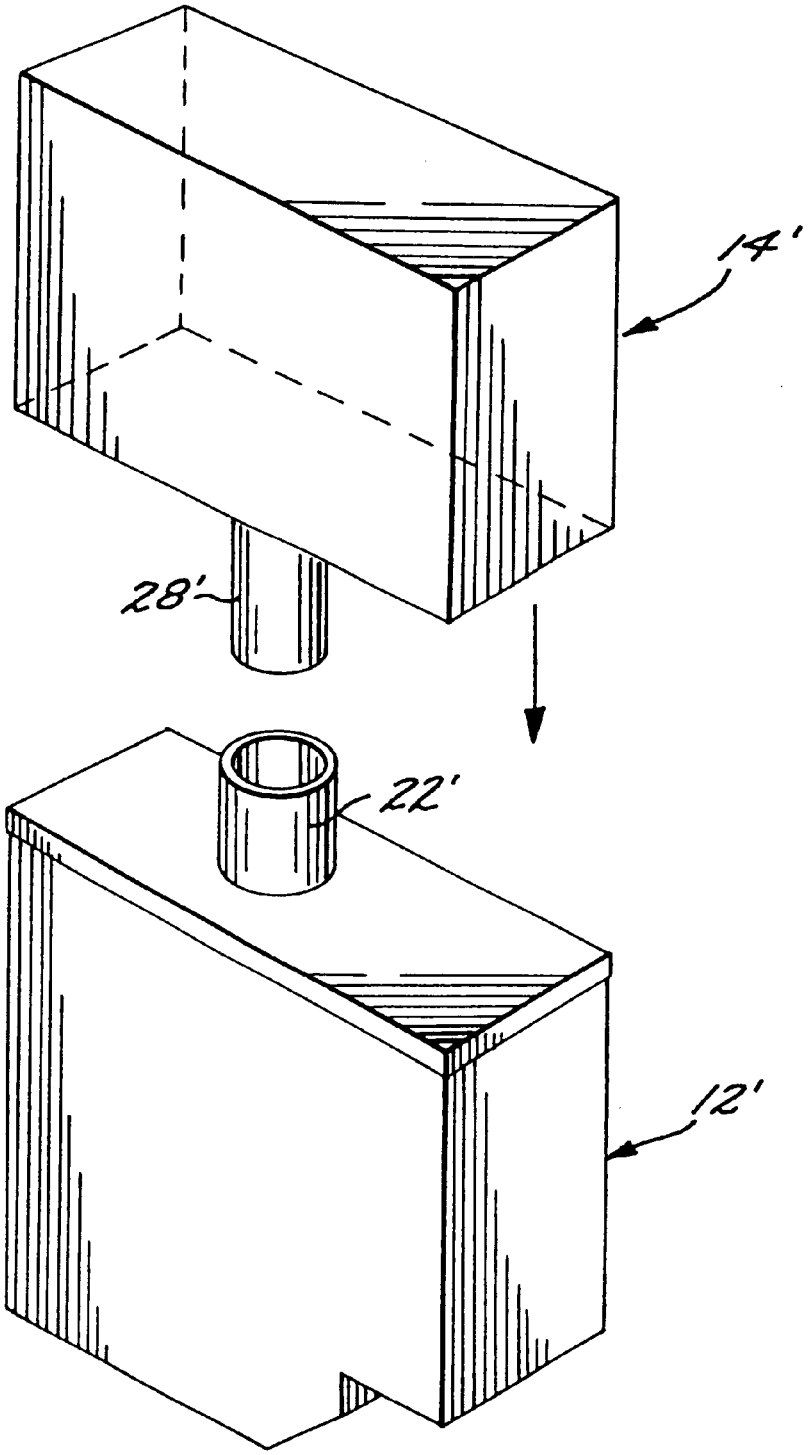
FIG. 13 is an isometric view of an alternative embodiment of the ink container and the printhead of the present invention with the ink container positioned for fluidic connection to the ink container.

FIG. 12 illustrates a solubility curve for water that plots air solubility in water versus water temperature. As can be seen from the curve, the solubility of water decreases as the temperature is raised. The thermal ink jet inks associated with this invention are at least partly water based. Hence, many will tend to have air solubility curves having a similar shape to that illustrated in FIG. 12.

When printhead 12 is operating, ejector portion 18 warms the ink in plenum 38. This causes ink near ejector portion 18 to be supersaturated with air, causing diffusion of air from the ink into bubbles in plenum 38. As a result, the bubbles grow in size.

One way to reduce the amount of outgassing is to include certain anti-outgassing additives that have the effect of reducing the slope of the solubility curve, thus reducing the outgas rate. A preferred additive that has this effect is ethoxylated glycerol. However, additional anti-outgassing additives suitable for use in the present invention include 2-pyrrolidone, N-methyl pyrrolidone, ethylene glycol, 2-propanol, 1-propanol, cyclohexanol, EHPD. The list below indicates even more additives:

(a) Ketones or ketoalcohols, such as acetone, methyl ethyl ketone, and diacetone ether.
(b) Ethers, such as dioxane.
(c) Esters, such as ethyl acetate, ethyl lactate, ethylene carbonate, and propylene carbonate.
(d) Diols, such as 1,4 butanediol, 1,2 pentanediol, 1,5 pentanediol, and 1,2 hexanediol.
(e) Polyhydric alcohols, such as ethylene glycol, diethylene glycol, triethylene glycol, neopentylglycol, polyethylene glycol, tetraethylene glycol, propylene glycol, dipropylene glycol, tripropylene glycol, glycerol, and thiodiglycol.
(f) Lower alkyl mono- or di-ethers derived from alkylene glycols, such as diethylene glycol mono-methyl (or -ethyl) ether, and tetraethylene glycol mono-methyl (or -ethyl) ether.

Preferably, the anti-outgassing additive, which may be one of the above constituents or a mixture thereof, is present in the range of at least 2% by weight and preferably 12% or more. An exemplary ink having con troll ed outgas properties is as follows:

| Component | Wt. % |
|---|---|
| Anti-outgassing additive (ethoxylated glycerol, etc.) | 12 |
| Coloring Agent (C.I. Direct Black 52) | 6 |
| Ink Vehicle (water plus additional solvents) | 80 |
| Additional Ingredients in combination (e.g. biocides, surfactants, Bleed control agents, buffers, etc.) | 2 |

The exemplary black ink indicated above has the average slope of the tangent to the solubility curve reduced to approximately ½ or less than that of water, between approximately 25° C. and 60° C. Looked at another way, the change in solubility of air in the ink between 25° C. and 60° C. is reduced to approximately half of the change expected for water by adding the additive. As a result, the exemplary black ink that has such an additive has a reduced outgas rate that is less than ½ of that of water. This results in a budget contribution of 1.6 cc of air.

An aspect of ink supply 14 that will increase the rate of outgassing is ink pressurization. Pressurization is typically done for printing systems requiring high flow rate printing to eliminate the effect of pressure drops between reservoir 82 and printhead 12. Referring to FIG. 11, a preferred embodiment of ink supply 14 includes a pressurization means 116 associated with ink supply 14. Pressurization means 116 can be a pump that is integral with ink supply 14. Alternatively, pressurization means 116 could be an air inlet that is in fluid communication with a region surrounding reservoir 82. A source of pressurized gas would then be connected to pressurization means 116 to pressurize the ink contained in fluid reservoir 82. In either case, the pressurization means provides pressurized ink at fluid outlet 28.

Pressurization will raise the solubility of gas in the ink contained in ink supply 14 via Henry's Law. If constant pressure is applied, the ink will become more saturated with air over time, increasing the outgas rate of the ink as it travels through printhead 12. One way to reduce the dissolved air is for pressurization means 116 to be an intermittent pressure source that only pressurizes the ink delivered to conduit 16 when necessary for printing and usually relieves pressure at fluid outlet 28 when printing system 10 is idle. Since most of the time is spent not printing, this minimizes the portion of outgassing contributed by pressurization.

Various sources of air accumulation and techniques for maintaining them within a budget have previously been described. For an exemplary printing system, these are summarized in TABLE 1. The sum of these sources for the exemplary system is approximately 4.5 cc. If the sum of these sources rises above 4.5 cc, then pressure regulation failures may occur, causing printhead 12 to drool into the printing system.

Printing system 10 has been described wherein a fluid conduit 16 fluidically couples and separates fluid inlet 22 from fluid outlet 28. FIG. 11 illustrates an alternative ink supply 14' that is pluggably mountable directly to printhead 12' in an "on carriage" configuration. Ink supply 14' includes fluid outlet 28' that directly connects to fluid inlet 22' associated with the printhead 12', eliminating the need for fluid conduit 16 therebetween. This would eliminate some major sources of air, including conduit or tubing startup, conduit or tubing diffusion, and one of the fluidic connections. This would have the effect of increasing printhead lifetime or decreasing the required air warehouse capacity.

Another alternative is to provide the pressure regulation and/or accumulator capacity in the ink supply 14' rather than the printhead 12'. This would tend to simplify the overall fluid delivery system, at the expense of accurate pressure control in printhead 12'.

What is claimed is:

1. An inkjet printing system of the type having a replaceable ink supply for providing ink to a printhead, the inkjet printing system comprising:

a semipermanent inkjet printhead having a fluid input for receiving ink and an ejection portion for selectively depositing ink in response to control signals, the inkjet printhead capable of printing a plurality of ink volumes;

a replaceable ink supply for storing one of the plurality of ink volumes, the replaceable ink supply configured for providing ink to the inkjet printhead; and an accumulator portion in fluid communication with the inkjet printhead and the replaceable ink supply, the accumulator portion compensates for air introduced into the inkjet printhead to maintain the printhead pressure range within an operating range allowing the printhead to print the plurality of ink volumes without purging air from the inkjet printhead; and wherein the semipermanent printhead is capable of printing over the life of at least five ink supplies.

2. The inkjet printing system of claim 1, wherein the printhead further comprises:

an internal plenum in fluid communication with the ejection portion; and a regulator valve that receives ink from the fluid input and provides ink to the plenum, the regulator valve opens and closes in response to pressure changes in the plenum to maintain a specified negative pressure in the plenum.

3. The inkjet printing system of claim 1, wherein the printhead includes an internal plenum in fluid communication with the ejection portion, the fluid accumulator including a flexible member having first and second surfaces, the first surface communicating with an outside atmosphere, the second surface communicating with ink in the internal plenum, the flexible member contracts in response to bubble expansion to maintain a negative internal pressure in the plenum.

4. The inkjet printing system of claim 1, further comprising a fluid conduit in fluid communication with the printhead at one end and having the fluid input at the other end.

5. A printing system, comprising:

a replaceable printhead capable of printing a plurality of ink volumes without purging air from the replaceable printhead, the printhead including an ejector portion for ejecting droplets of ink in response to control signals, the printhead including an internal plenum in communication with the ejector portion, the printhead including an accumulator that compensates for expansion of accumulated air in the plenum, the printhead including a fluid inlet that is fluidically coupled to the plenum for providing ink to the plenum;

a fluid conduit having a self-sealing conduit outlet adapted to be fluidically coupled to the fluid inlet, the conduit outlet self-seals when it is uncoupled from the fluid inlet to prevent air from entering the conduit outlet, the fluid conduit including a self-sealing conduit inlet, the fluid conduit including a portion formed from a high air barrier material having an oxygen permeability characteristic of less than 100 c·mil/(11 $in^2$·day·atm), at 23° C., 0% Rh; and a replaceable ink supply having a fluid outlet adapted to be fluidically coupled to the conduit inlet, the conduit inlet self-seals when it is uncoupled from the fluid inlet to prevent air from entering the conduit inlet, the replaceable ink supply including a fluid reservoir in fluid communication with the fluid outlet for containing one of the plurality of ink volumes.

6. The printing system of claim 5, wherein the high air barrier material is a polymer chosen from the group consisting of polyvinylidene chloride copolymer, polychlorotrifluoroethylene, and ethylenechlorotrifluoroethylene.

7. The printing system of claim 5, further comprising a valve fluidically interposed between and fluidically connecting the fluid outlet and the plenum, the valve opens and closes in response to pressure changes in the plenum to maintain a negative pressure in the plenum to assure proper operation of the ejector portion.

8. An apparatus for providing ink to a printing system, the printing system including a semipermanent printhead having an ejector portion for depositing ink in response to control signals, the printhead capable of printing a plurality of ink volumes, the printhead including an internal plenum in communication with the ejector portion, the internal plenum having a negative internal pressure to prevent printhead failure, the plenum including an accumulator portion that is adapted to accommodate expansion and contraction of up to a warehouse volume of air in the plenum while maintaining the negative internal pressure, the internal plenum fluidically coupled to a self-sealing fluid coupling device, the apparatus including:

a reservoir for storing one of the plurality of ink volumes, the reservoir adapted to be releasably mounted to the printing system;

a fluid outlet in communication with the reservoir, the fluid outlet adapted to fluidically couple to the fluid coupling device when the reservoir is releasably mounted to the printing system, and the fluid outlet is adapted to introduce less than 0.02 cc of air when it is coupled and uncoupled from the fluid coupling device; and wherein ink that flows out of the reservoir, through the fluid outlet, and to the internal plenum when the reservoir is releasably mounted to the printing system, the ink carrying dissolved and free air to the plenum, and wherein the reservoir, the fluid outlet, the and the ink are adapted to provide less than the warehouse volume of air during the life of the printhead without purging air from the printing system.

9. The apparatus of claim 8, wherein the accumulator portion includes a flexible member having first and second surfaces, the first surface communicating with an outside atmosphere, the second surface communicating with ink in the internal plenum, the flexible member contracts in response to bubble expansion to maintain a negative internal pressure in the plenum.

10. The apparatus of claim 8, wherein the printhead includes a valve in fluid communication with the plenum, the valve is fluidically coupled to the fluid outlet, the valve opens and closes in response to pressure changes in the plenum to maintain a negative pressure range in the plenum that assure proper operation of the ejector portion.

11. The apparatus of claim 8, wherein the fluid coupling device includes a needle including an outlet hole, the needle is surrounded by a sliding collar, the fluid outlet is adapted to engage the needle and the sliding collar to move the sliding collar from a sealed position wherein the sliding collar seals the outlet hole to a unsealed position wherein the outlet hole is fluidically coupled to the fluid outlet.

12. The apparatus of claim 11, wherein the needle and the sliding collar are surrounded by a cylindrical boss, the fluid outlet is sized to be received in the cylindrical boss while providing alignment and proper fluidic connection between the needle and the distal end of the fluid outlet.

13. The apparatus of claim 8, wherein the ink includes an additive that reduces the outgas rate of the ink below that of water.

14. The apparatus of claim 13, wherein the additive is in a concentration of at least 2 weight percent of the ink.

15. The apparatus of claim 14, wherein the additive is in a concentration of at least 10 weight percent of the ink.

16. The apparatus of claim 8, wherein the printing system includes a fluid conduit having a first end that is fluidically coupled to the plenum, a second end fluidically coupled to the self-sealing fluid coupling device, and a flexible portion therebetween to allow the first end to scan with the printhead and the self-sealing coupling device to be stationary relative to the printhead.

17. The apparatus of claim 8, wherein the self-sealing fluid coupling device scans with the printhead.

* * * * *

UNITED STATES PATENT AND TRADEMARK OFFICE

CERTIFICATE OF CORRECTION

PATENT NO. : 6,382,784 B2
DATED : May 7, 2002
INVENTOR(S) : Norman E. Pawlowski, Jr. et al.

It is certified that error appears in the above-identified patent and that said Letters Patent is hereby corrected as shown below:

Title page,
Item [57], ABSTRACT,
Line 17, "life" should read -- life of --;

Column 14,
Line 66, "the and" should read -- and --.

Signed and Sealed this

Eighteenth Day of February, 2003

JAMES E. ROGAN
*Director of the United States Patent and Trademark Office*